US009506325B2

(12) United States Patent
Fould et al.

(10) Patent No.: US 9,506,325 B2
(45) Date of Patent: Nov. 29, 2016

(54) MULTILATERAL SYSTEM WITH RAPIDTRIP INTERVENTION SLEEVE AND TECHNIQUE FOR USE IN A WELL

(75) Inventors: Jeremie C. Fould, Courbevoie (FR); Timothy M. O'Rourke, Austin, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 814 days.

(21) Appl. No.: 13/497,311

(22) PCT Filed: Sep. 21, 2009

(86) PCT No.: PCT/US2009/057717

§ 371 (c)(1),
(2), (4) Date: Sep. 5, 2012

(87) PCT Pub. No.: WO2011/034547

PCT Pub. Date: Mar. 24, 2011

(65) Prior Publication Data

US 2012/0318582 A1 Dec. 20, 2012

(51) Int. Cl.
*E21B 41/00* (2006.01)
*E21B 43/14* (2006.01)

(52) U.S. Cl.
CPC ..... *E21B 41/0035* (2013.01); *E21B 43/14* (2013.01)

(58) Field of Classification Search
CPC ..... E21B 41/0035; E21B 43/14
USPC ..... 166/50, 117.5, 117.6, 308.1, 381, 241, 166/191, 313, 366
See application file for complete search history.

(56) References Cited

U.S. PATENT DOCUMENTS

| | | | | |
|---|---|---|---|---|
| 5,311,936 | A | 5/1994 | McNair et al. | |
| 5,318,121 | A | 6/1994 | Brockman et al. | |
| 5,322,127 | A * | 6/1994 | McNair et al. | 166/313 |
| 6,209,644 | B1 * | 4/2001 | Brunet | 166/297 |
| 8,695,694 | B1 * | 4/2014 | Lajesic | 166/117.6 |
| 2001/0025710 | A1 | 10/2001 | Ohmer et al. | |
| 2005/0115713 | A1 | 6/2005 | Restarick et al. | |
| 2006/0201677 | A1 | 9/2006 | Moody et al. | |

OTHER PUBLICATIONS

International Search Report and Written Opinion of PCT Application No. PCT/US2009/057717 dated Nov. 5, 2009.

* cited by examiner

*Primary Examiner* — Kenneth L Thompson
*Assistant Examiner* — David Carroll
(74) *Attorney, Agent, or Firm* — Michael Stonebrook

(57) ABSTRACT

A method for constructing a multilateral well includes drilling a main well, drilling a first lateral well from the main well, installing a production reentry deflection tool in the main well, proximate the first lateral, the first production reentry deflection tool having a first inner diameter, drilling a second lateral well from the main well and above the first lateral well, and installing a second production reentry deflection tool in the main well, proximate the second lateral, the second production reentry deflection tool having a second inner diameter. The first inner diameter is smaller than the second inner diameter.

3 Claims, 18 Drawing Sheets

MULTILATERAL SYSTEM WITH RAPIDTRIP INTERVENTION SLEEVE AND TECHNIQUE FOR USE IN A WELL

BACKGROUND

The invention generally relates to oil and gas wells and the like. More specifically, the invention relates to a multilateral tubing system and technique for use in a TAML Level 2 well.

Various tools (valves, chokes, packers, perforating guns, injectors, as just a few examples) typically are deployed downhole in a well during the well's lifetime for purposes of testing, completing and producing well fluid from the well. A number of different conveyance mechanisms may be used for purposes of running a particular tool into the well. As examples, a typical conveyance mechanism device may be a coiled tubing string, a jointed tubing string, a wireline, a slickline, etc.

Once deployed in the well, a given tool may be remotely operated from the surface of the well for purposes of performing a particular downhole function. For this purpose, a variety of different wired or wireless stimuli (pressure pulses, electrical signals, hydraulic signals, etc.) may be communicated downhole from the surface of the well to operate the tool.

To enter a side track well in a multilateral well, it is typically necessary to install a deflector at an appropriate position near the lateral well to be entered. The deflector will deflect the working tool, when it is run into the hole, so that it will be deflected from the main well bore into the selected multilateral well.

Deflector nipple profiles are used today as a completion means to perform the this operation. However, in these tools, a deflector has to be run prior to running the coil tubing string in the upper zone. Then, the deflector has to be retrieved.

SUMMARY OF THE DISCLOSURE

In one aspect, the invention relates to a method for constructing a multilateral well that includes drilling a main well, drilling a first lateral well from the main well, installing a production reentry deflection tool in the main well, proximate the first lateral, the first production reentry deflection tool having a first inner diameter, drilling a second lateral well from the main well and above the first lateral well, and installing a second production reentry deflection tool in the main well, proximate the second lateral, the second production reentry deflection tool having a second inner diameter. The first inner diameter may be smaller than the second inner diameter.

In another aspect, the invention relates to a multilateral well that includes a mail well, a first lateral well extending from the main well, a second lateral well extending from the main well, above the first well, a first production reentry deflection sub positioned in the main well proximate the first lateral well, the first production reentry deflection sub having a first inner diameter, and a second production reentry deflection sub positioned in the main well proximate the second lateral well, the second production reentry deflection sub having a second inner diameter that is larger than the first inner diameter.

In another aspect, the invention related to a method of entering a lateral well that includes selecting a nose size corresponding to a size of an inner diameter of a production reentry deflection sub positioned proximate the lateral well to be entered, positioning a nose with the selected size at the end of a work string, and running the work string into a main well such that the nose engages the production reentry deflection sub and is deflected into the lateral well.

DETAILED DESCRIPTION

Figure 1:
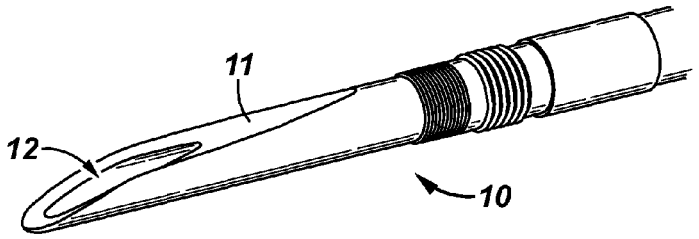
FIG. 1 shows an example production reentry defection tool.

FIG. 1 shows an example of a production reentry deflection tool 10 ("PRDT"), having an ID 12 and a deflection surface 11 whose size depends on the ID 12 of the PRDT 10.

Figure 2:
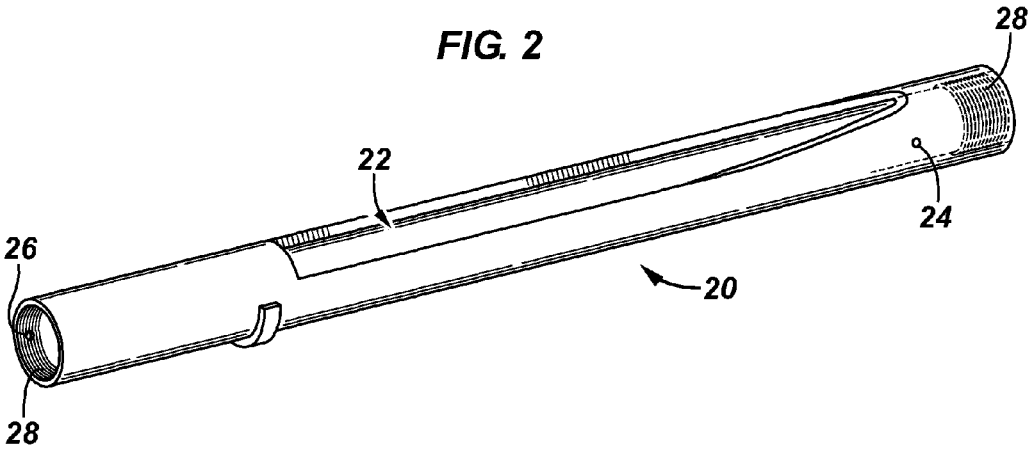
FIG. 2 shows an example intervention sleeve.

FIG. 2 shows an intervention sleeve 20 which may be connected with the PRDT (10 in FIG. 1) by means of locking screws (not shown) placed through the locking screws holes 24 and running shear holes 26. The sleeve 20 features a milled window 22 which is long enough to insure that the top of the sleeve 20 will be in full casing once the PRDT 10 is set. The sleeve 20 has identical threads 22 per the PRDT tool design.

Figure 3:
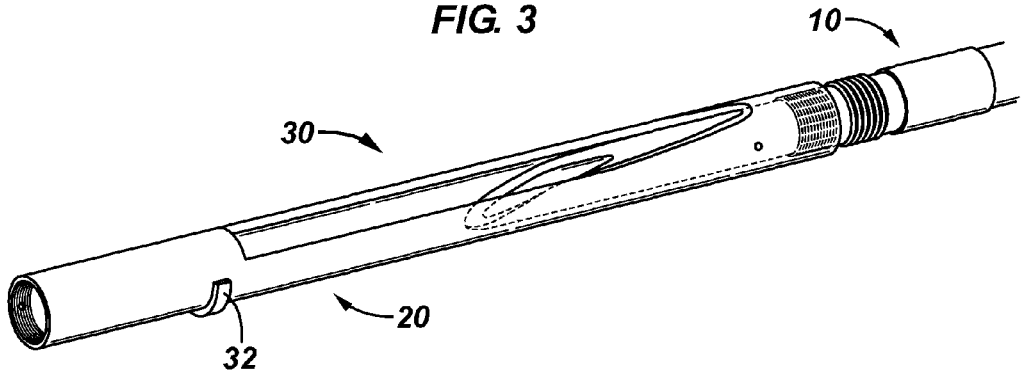
FIG. 3 shows an example of a production reentry defection tool and an intervention sleeve that are connected.

FIG. 3 shows the tool assembly 30, as ready for running in the hole, where the sleeve 20 placed over the PRDT 10, having a support 32 for centralizing the sleeve in the well casing.

Figure 4:
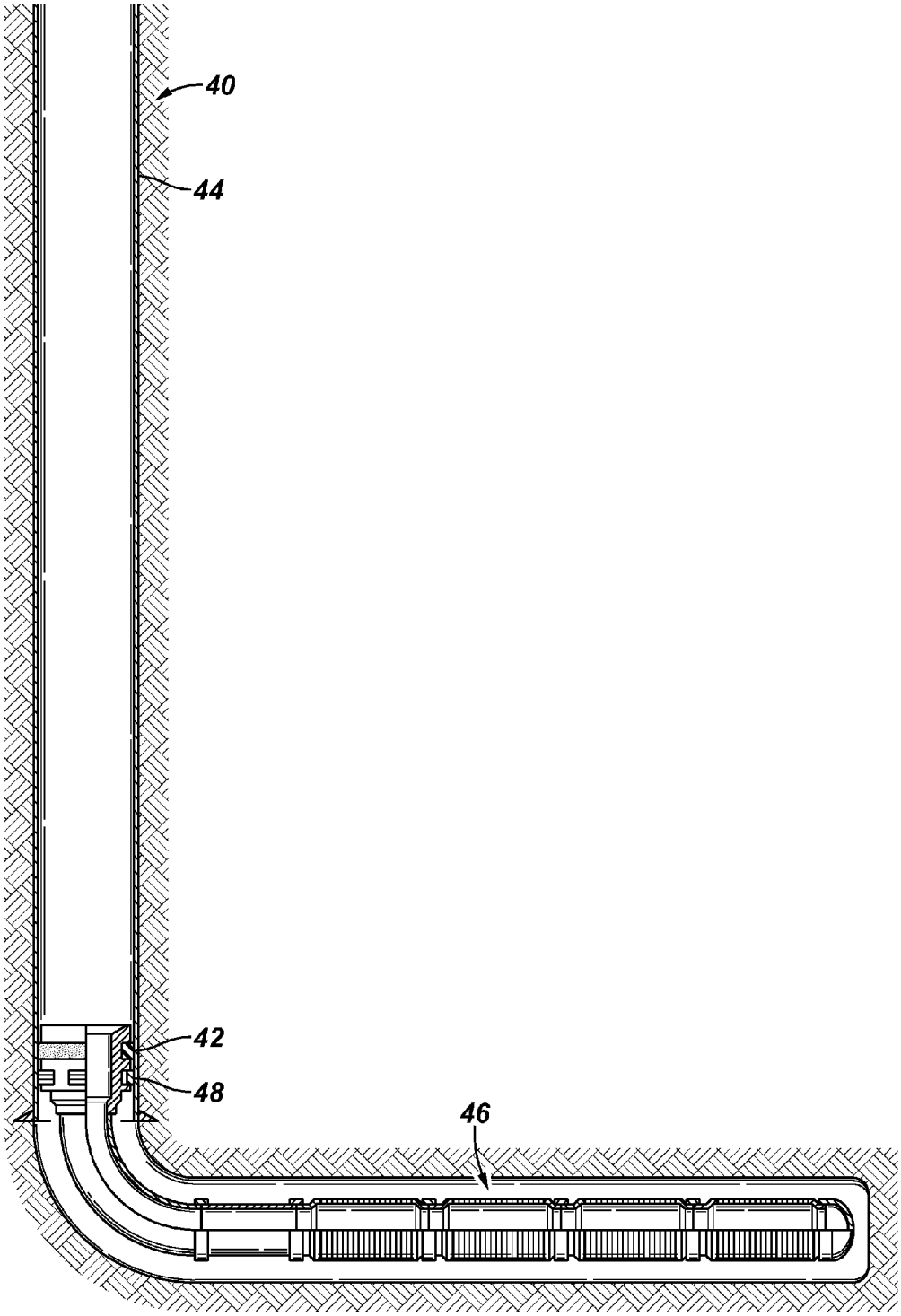
FIG. 4 is a schematic diagram of an example lower completion assembly in a well.

FIGS. 4-17 depict various example phases of the well 40 during the example operations that will be explained. FIG. 4 shows a well 40 with a casing and/or liner 44 that has been installed in the well 40. A packer with a liner hanger 42 has been installed at the lower end of the liner 44, and a lower completion 46 has been installed in the lower section of the well 40. The packer 42 may include latch 48. A lower completion may, for example, include open hole packers, perforated screens, sand screens, flow control valves, and combinations thereof.

Figure 5:
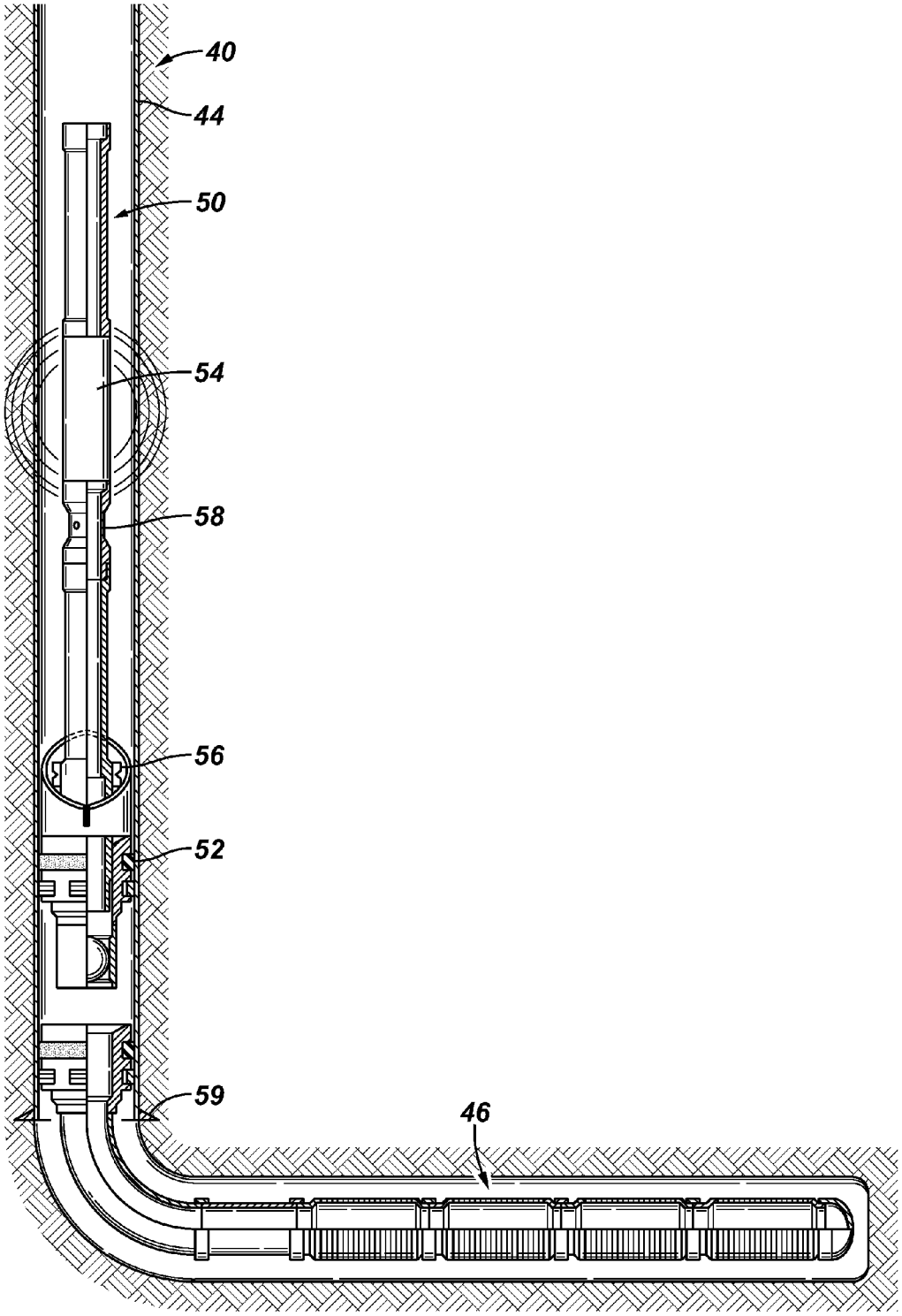
FIG. 5 is a schematic diagram of an example assembly orienting an anchor packer in a main well.

Referring now to FIG. 5, a tubular work string 50 may be deployed in a well bore 40 for purposes of running, orienting, and setting an anchor packer 52 in a single downhole trip. It is noted that a "work string" may refer to any string that is run into the hole, and it may include strings made of drill pipe, coiled tubing, and a slickline, as examples.

The work string 50 includes a lower assembly that includes a measurement while drilling (MWD) assembly 54; a packer setting tool 56; and the anchoring packer 52. The MWD assembly 54 is used, as described further below, for purposes of measuring and communicating packer orientation data (data indicative of an azimuth of the packer 52, for example) to the surface of the well. Thus, after the packer 52 is run downhole in the vicinity of its setting depth, the work string 50 may be rotated until the signal communicated by the MWD assembly 54 indicates that the packer 52 is in the proper orientation. When this occurs, the packer setting tool 56 may be actuated (as described in more detail herein) to set the packer 52, i.e., cause expansion of slips, or dogs, of the packer 52 and causes the radial expansion of one or more annular sealing elements of the packer 52.

It is noted that FIG. 5 is merely an example of one of many possible strings that may contain an anchor packer 52 and an MWD 54, in accordance with many different contemplated embodiments of the invention. Although FIG. 5 depicts the wellbore 40 as being cased by a casing string 44, it is noted that the systems and techniques that are disclosed herein may likewise be used in connection with uncased wellbores.

The technique may include the steps running the work string 50 downhole such that above the setting depth, fluid is communicated through a primary flow path, or central passageway, of the work string 50, and the MWD signal may be propagated through the central passageway. Using the orientation signal that is provided by the MWD assembly 54, the drill string 50 is manipulated (rotated, for example) at the surface of the well 10, until it is determined that the packer 52 has the intended orientation.

After the packer 52 is set, the packer setting tool 56 is operated to release a latch that secures the packer 52 to the setting tool 56 for purposes of releasing the packer 52 from the setting tool 56. As a more specific example, in accordance with some embodiments of the invention, a predetermined mechanical movement of the drill string 50 may cause the setting tool 56 to release the packer 52.

Alternatively, the packer setting tool 56 may release the packer 52 in response certain wired and/or wireless stimuli that are communicated downhole from the surface of the well 10, as another non-limiting example. After the packer 52 is released from the packer setting tool 56, the setting tool 56 and the remaining part of the drill string above the setting tool 56 are pulled out of the well 40, which leaves the packer 52 and liner hanger 59 in the well 10.

The packer 52 is an example of one of many possible tools that may be run downhole, oriented and actuated, in accordance with embodiments of the invention. For example, in accordance with other embodiments of the invention, the packer 52 may be replaced by an oriented perforating gun, whipstock, etc. Additionally, the techniques and systems that are described herein are likewise applicable to overcoming obstructions other than the obstruction introduced by a flow modulator. As another example, the drill string 50 may include a section that has a reduced inner diameter that is sufficiently small to prohibit a ball from passing through the section. Thus, many variations are contemplated and are within the scope of the appended claims.

Figure 6:
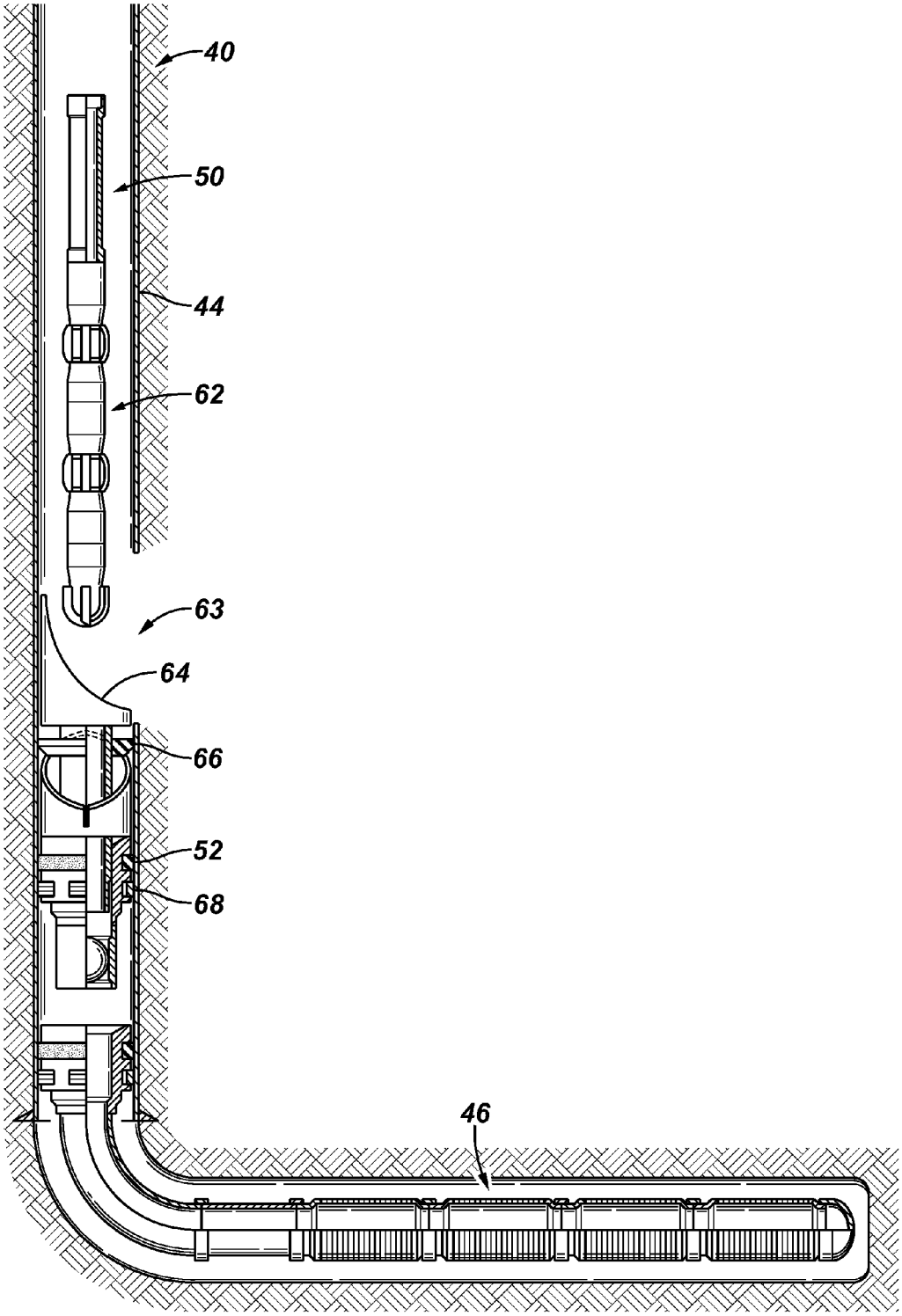
FIG. 6 is a schematic diagram of an example assembly for milling a lateral well from a main well.

FIG. 6 shows an example schematic of an assembly for milling a sidetrack in the casing 44. A whipstock 64 is run into the hole and may engage the anchor latch 68 in the anchor packer 52. A work string 50 is deployed in the well bore 40 for milling a window in the casing 44. The milling assembly 62 is biased by the whipstock 64 as the work string 50 is moved downward. A debris retainer 66 may be installed with the whipstock 64 to prevent the debris from milling from falling lower in the well 40. Through the use of the example assembly shown in FIG. 6, a window 63 may be milled in the side of the casing 44.

Figure 7:
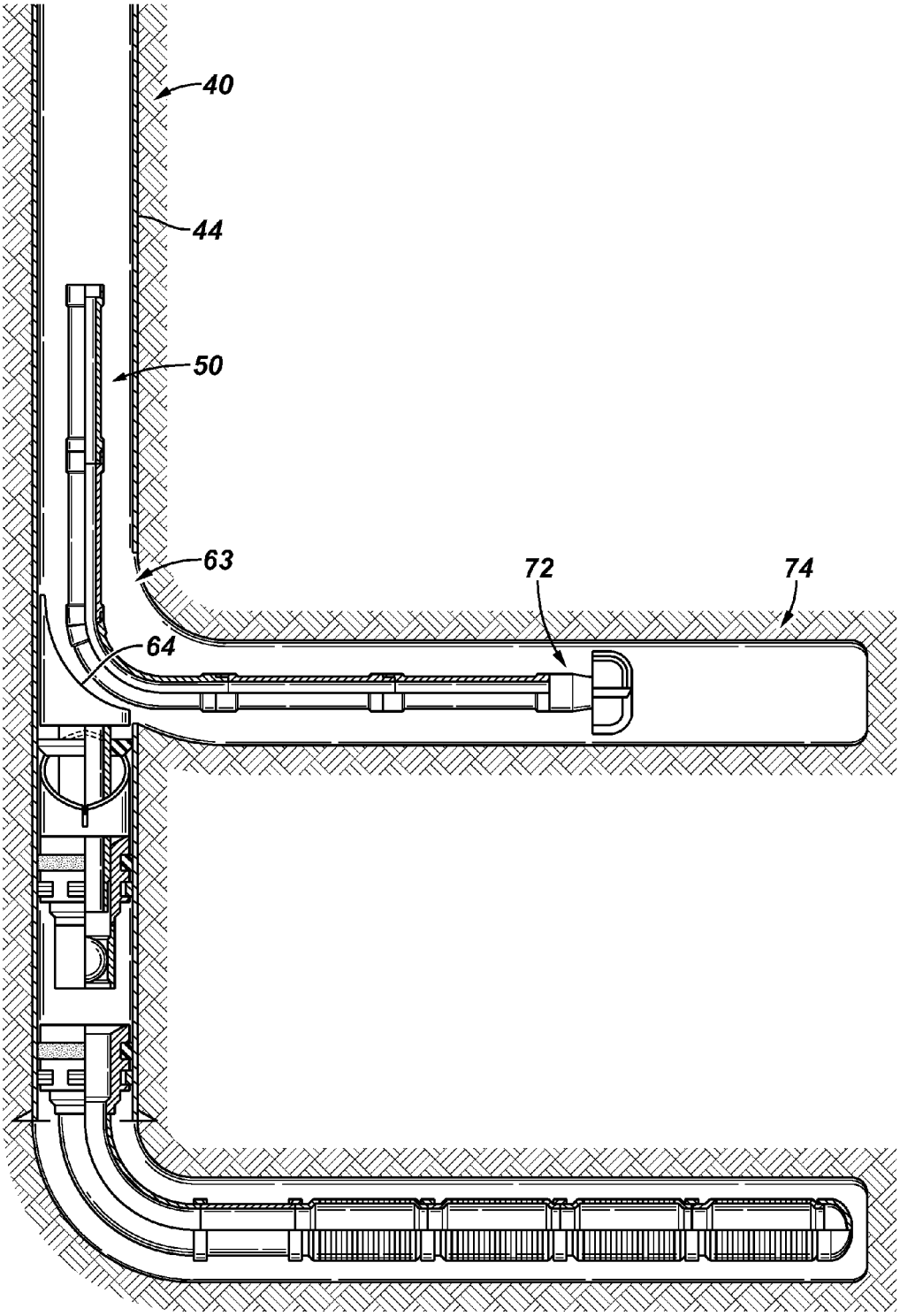
FIG. 7 is a schematic diagram of an example assembly for drilling a lateral well.

FIG. 7 shows a work string 50 in the wellbore 40 having a drilling bottom hole assembly (BHA) 72 for drilling a lateral bore 74. The BHA 72, when it passes the whipstock 64, is diverted through the window 63 so that it may drill the lateral wellbore 74, as is know in the art.

Figure 8:
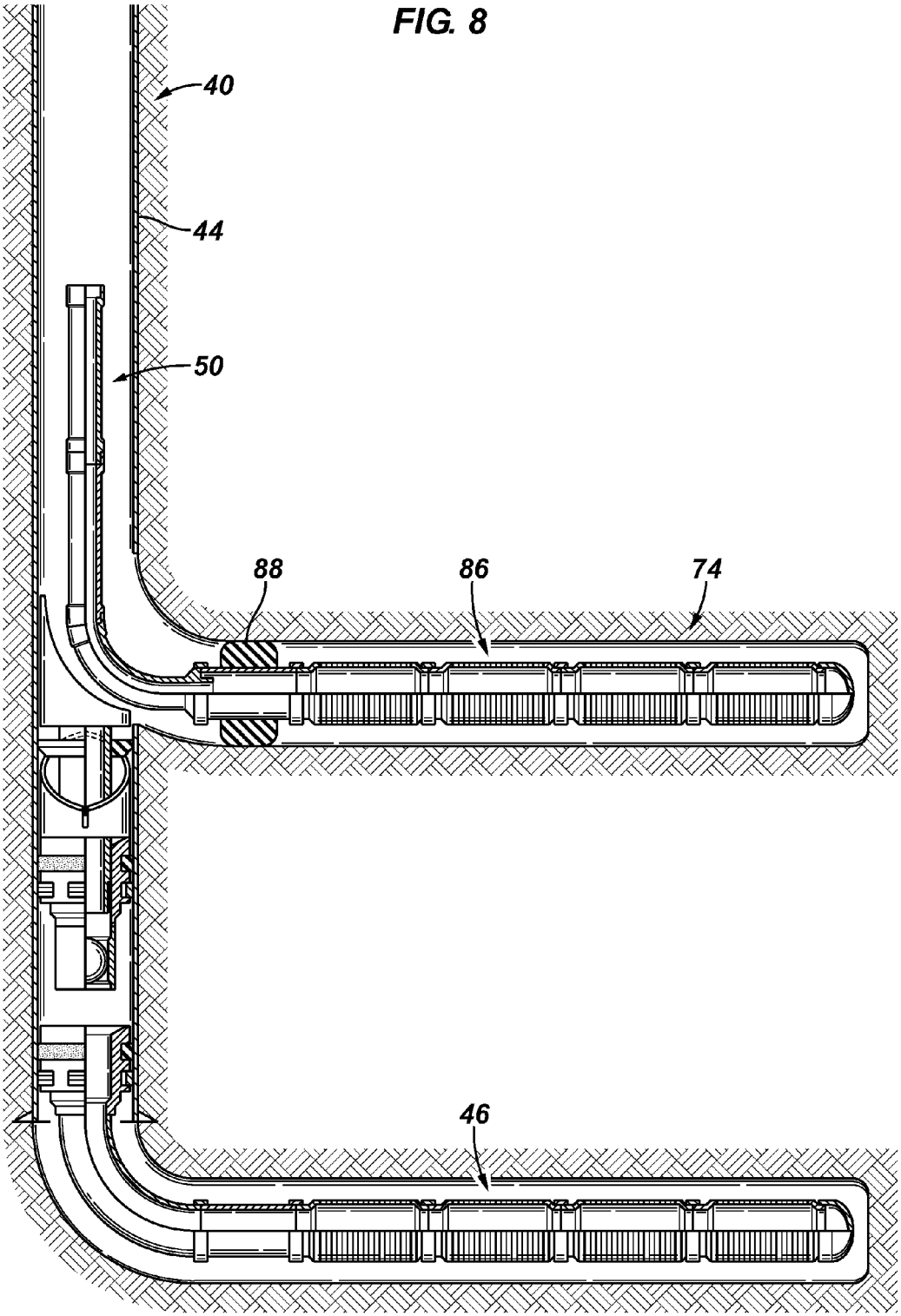
FIG. 8 is a schematic diagram of an example of a lower completion installed in a lateral well.

FIG. 8 shows an example of a lower completion assembly positioned within the lateral wellbore 74. In the example shown in FIG. 8, the lower completion include screens 86 and a swellable open hole packer 88 to isolate the fluids in the lateral bore 74.

Figure 9:
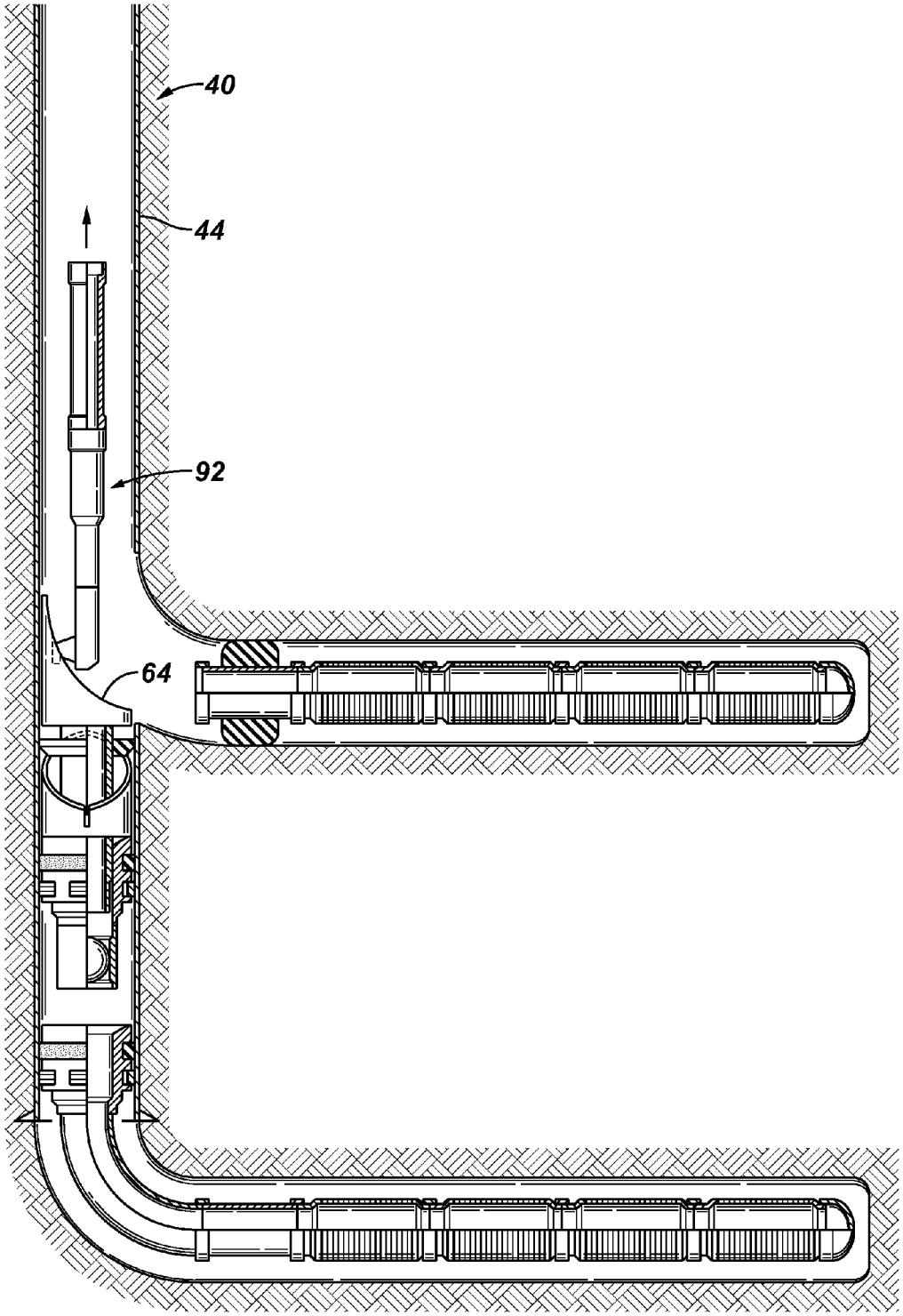
FIG. 9 is a schematic diagram of an example hook and fishing assembly for retrieving a lateral drilling whipstock.

FIG. 9 shows an example schematic of a retrieving hook and fishing assembly 92 placed in the main wellbore 40 to release the whipstock 64 and pull it out of the hole.

Figure 10:
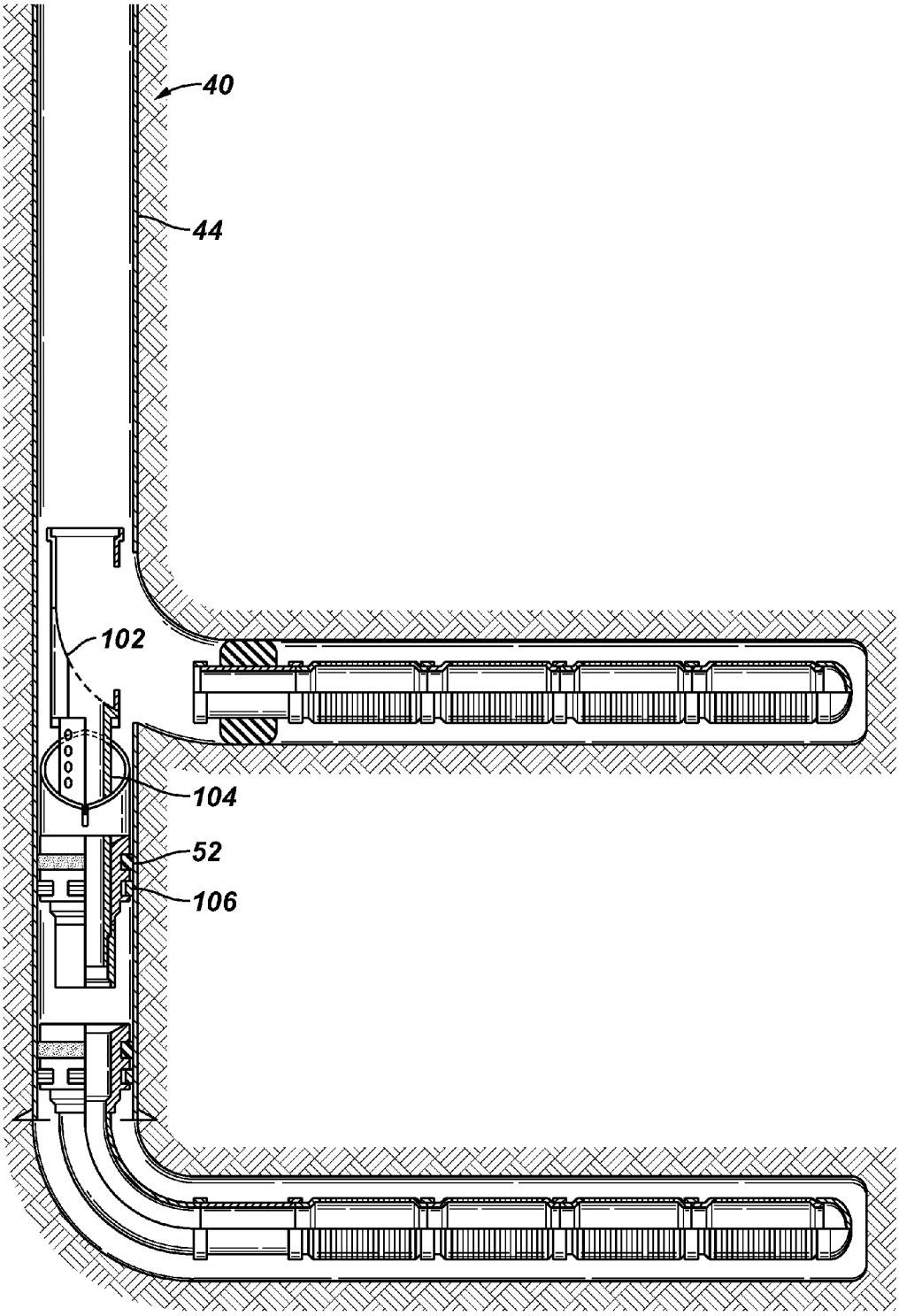
FIG. 10 is a schematic diagram of an example PRDT with selective access sleeve installed in a multilateral junction.

FIG.10 shows a schematic of an example PRDT and intervention sleeve assembly 102 that has been installed in a production latch 106 within the orientation packer 52. The PRDT and sleeve assembly 102 may be attached to a bypass extender sub 104. The bypass extender sub 104 may include holes, slits, or other perforation to allow well fluids to exit the tubular and flow around the PRDT and intervention sleeve assembly 102. The PRDT of assembly 102 may be selected to have a first ID (12 in FIG. 1) size that, as will be explained, is smaller than the ID of additional PRDTs that may be installed in the well 40 above the PRDT of assembly 102.

Figure 11:
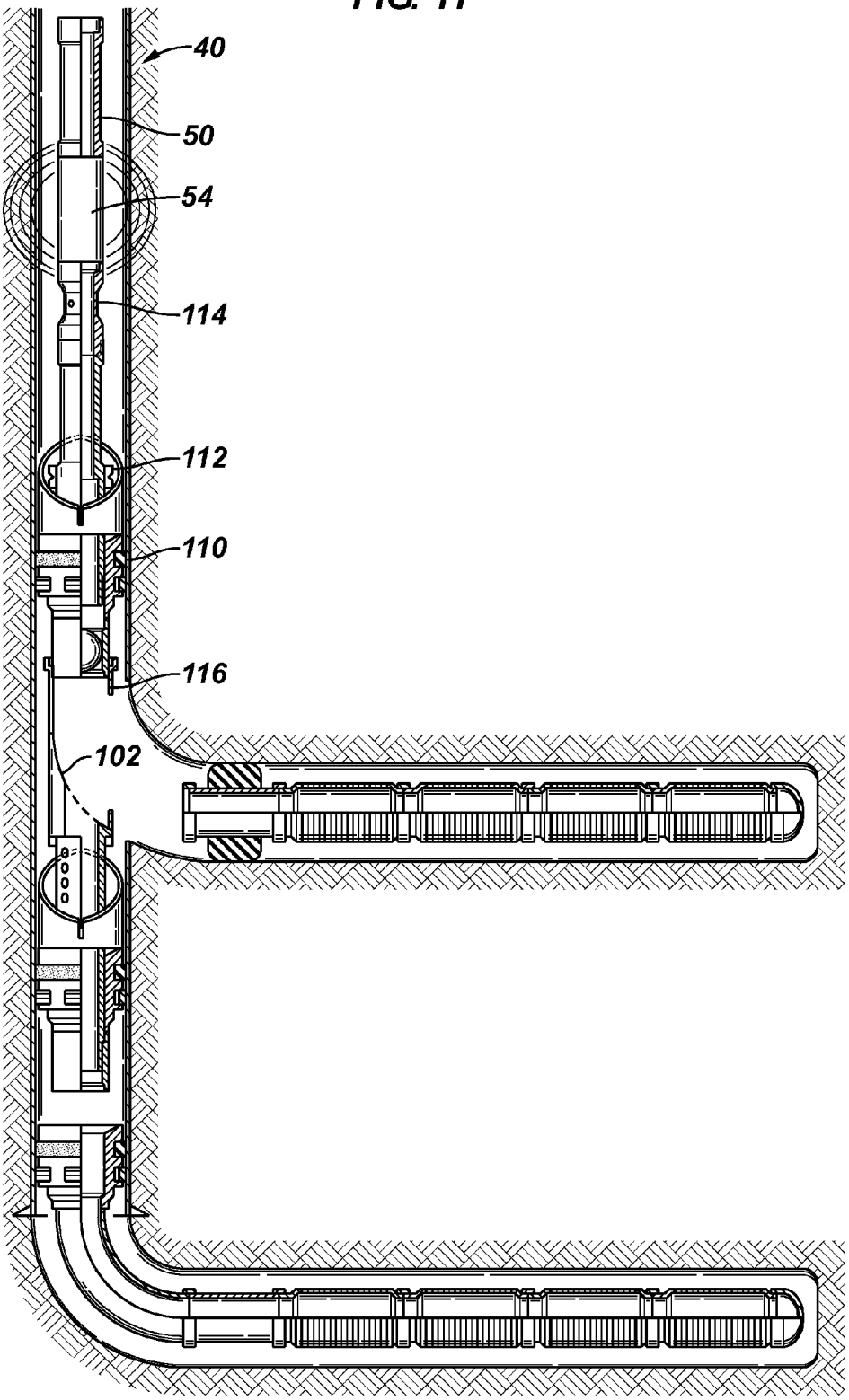
FIG. 11 is a schematic diagram of an example assembly orienting an anchor packer in a main well.

FIG. 11, similar to FIG. 5, shows an example work string 50 that is run to place a second anchor packer 110, using a second packer setting tool 112. The MWD tool 54 may be used to detect the orientation of the packer 110 and to transmit that information to the surface. The packer setting tool 112 may be used to set the packer 110 in a desired location and orientation. The drill string also contains a circulating valve 114 that directs the flow in the central passageway (which emerges from the MWD assembly 54) through its radial fluid communication ports and into the annulus of the well, where the flow returns to the surface of the well. Thus, during the orienting of the packer 52, part of the flow that is modulated by the MWD assembly 54 is routed through the radial circulation ports of the circulating valve 114 into the annulus, and this flow returns to the surface of the well. Below the packer 110, a stabbing guide 116 may be included so that future well entries will be oriented to properly enter the PRDT below, as will be explained.

Figure 12:
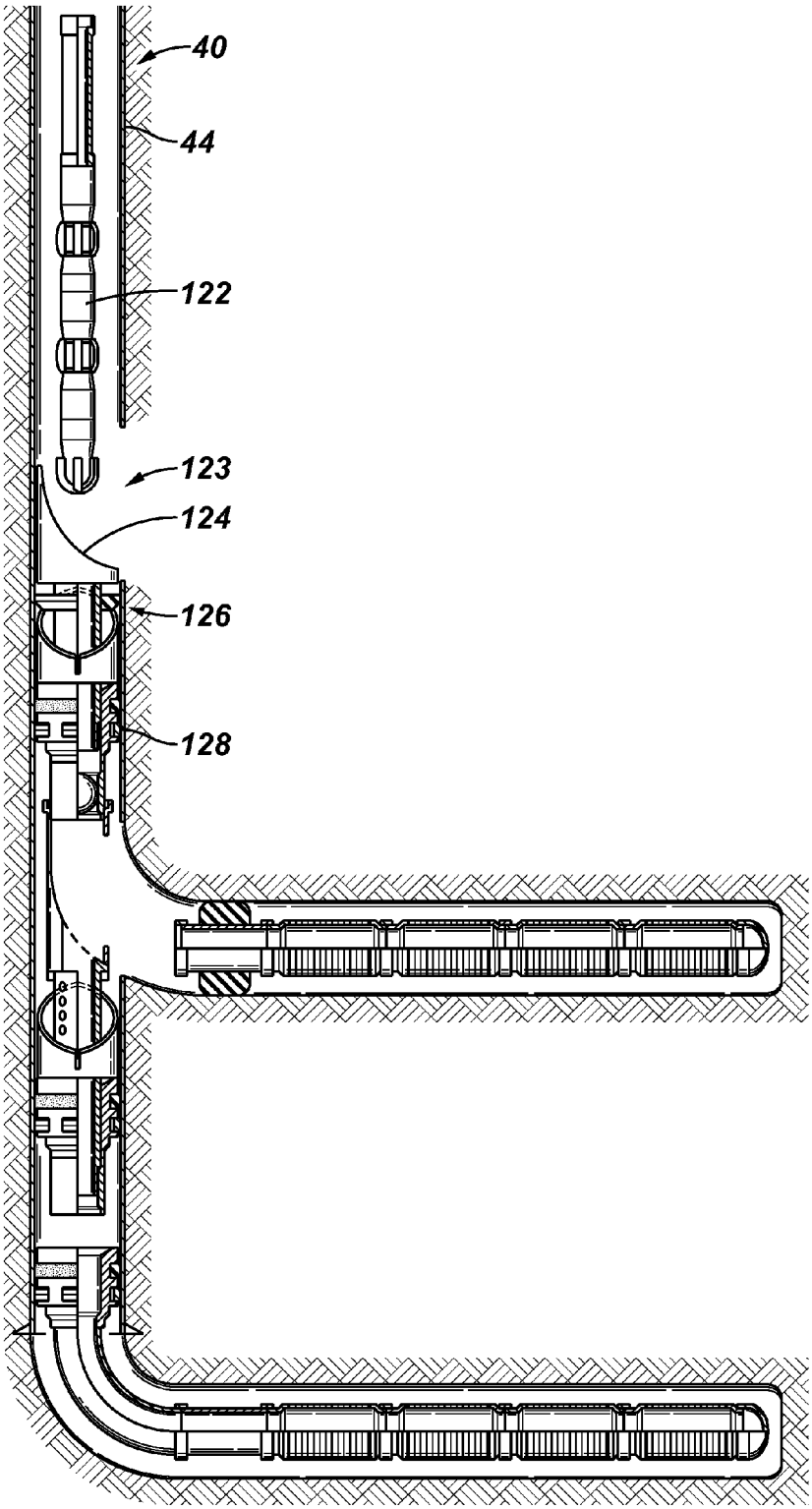
FIG. 12 is a schematic diagram of an example assembly for milling a lateral well from a main well.

FIG. 12, similar to FIG. 6, shows a whipstock 124 and a debris retainer 126 that have been connected to an anchor latch in the orientation packer 110. A mill assembly 122 may be used to mill a second window 123 in the casing 44. The mill assembly 122 may be biased by the whipstock 124 to mill the second window 123.

Figure 13:
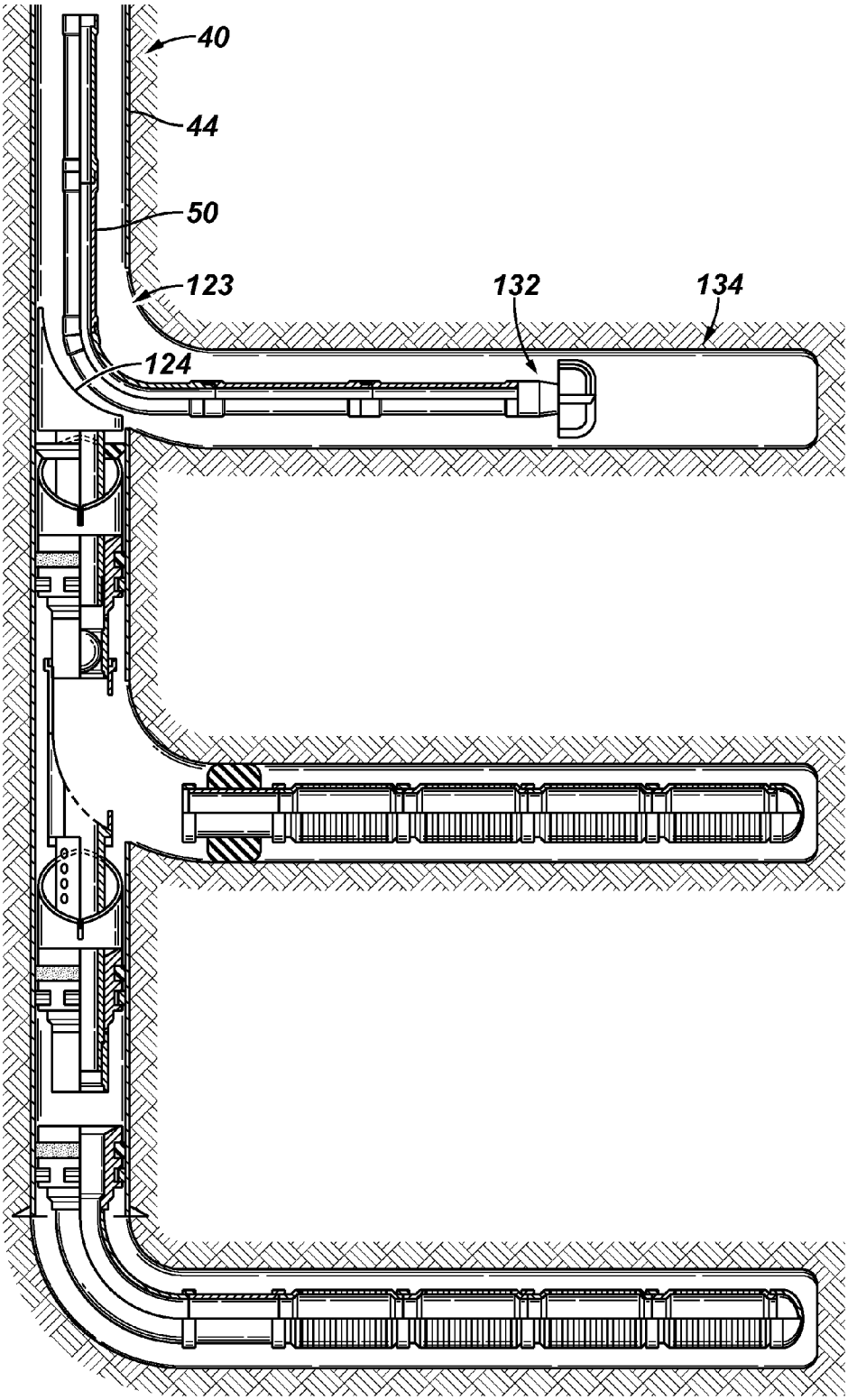
FIG. 13 is a schematic diagram of an example assembly for drilling a lateral well.

FIG. 13, similar to FIG. 7, shows a work string 50 in the wellbore 40 having a drilling bottom hole assembly (BHA) 132 for drilling a lateral bore 134. The BHA 132, when it passes the whipstock, is diverted through the window 123 so that it may drill the lateral wellbore 134, as is know in the art.

Figure 14:
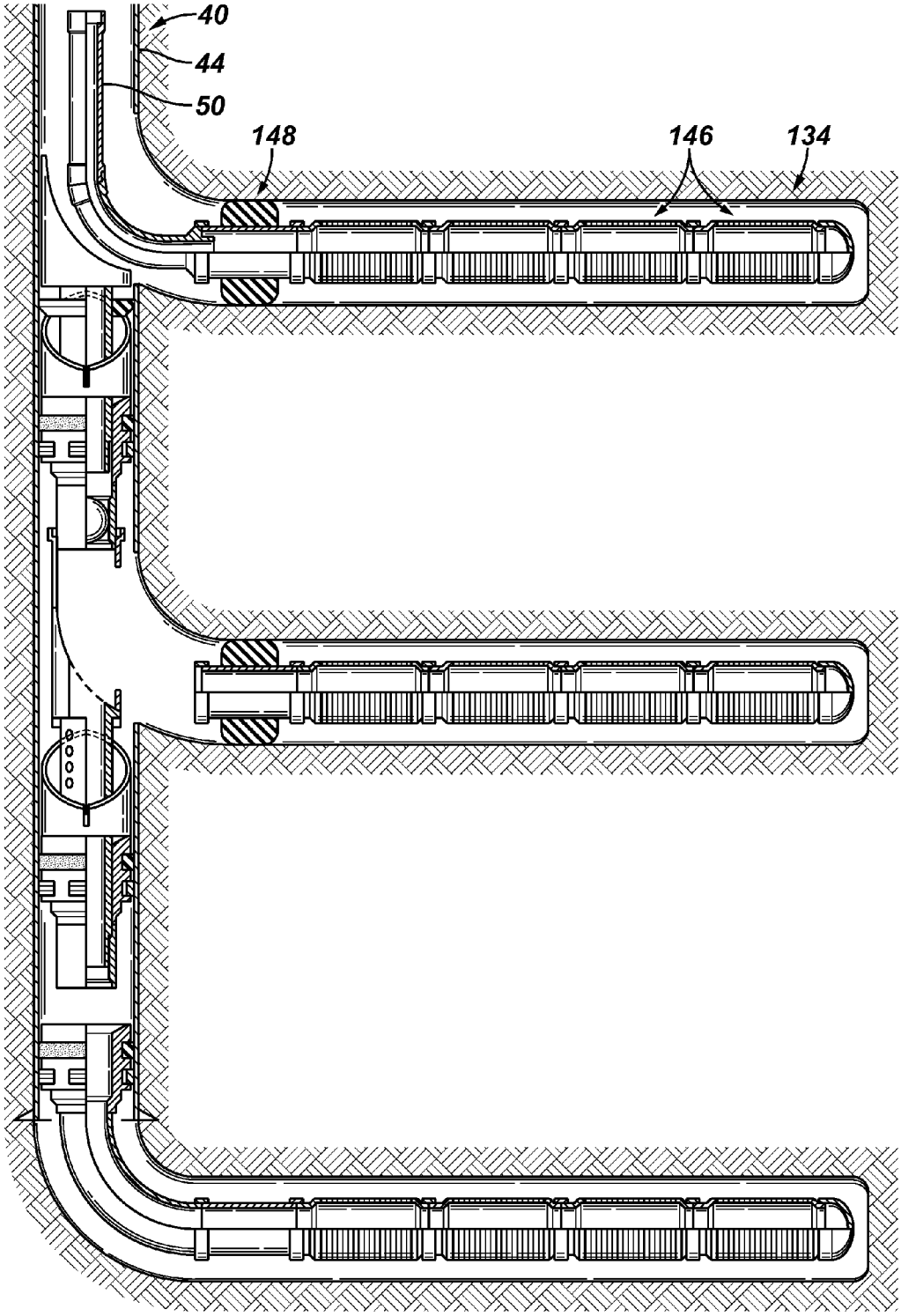
FIG. 14 is a schematic diagram of an example of a lower completion installed in a lateral well.

FIG. 14, similar to FIG. 8, shows an example of a lower completion assembly positioned within the lateral wellbore 134. In the example shown in FIG. 8, the lower completion include screens 146 and a swellable open hole packer 148 to isolate the fluids in the lateral bore 134.

Figure 15:
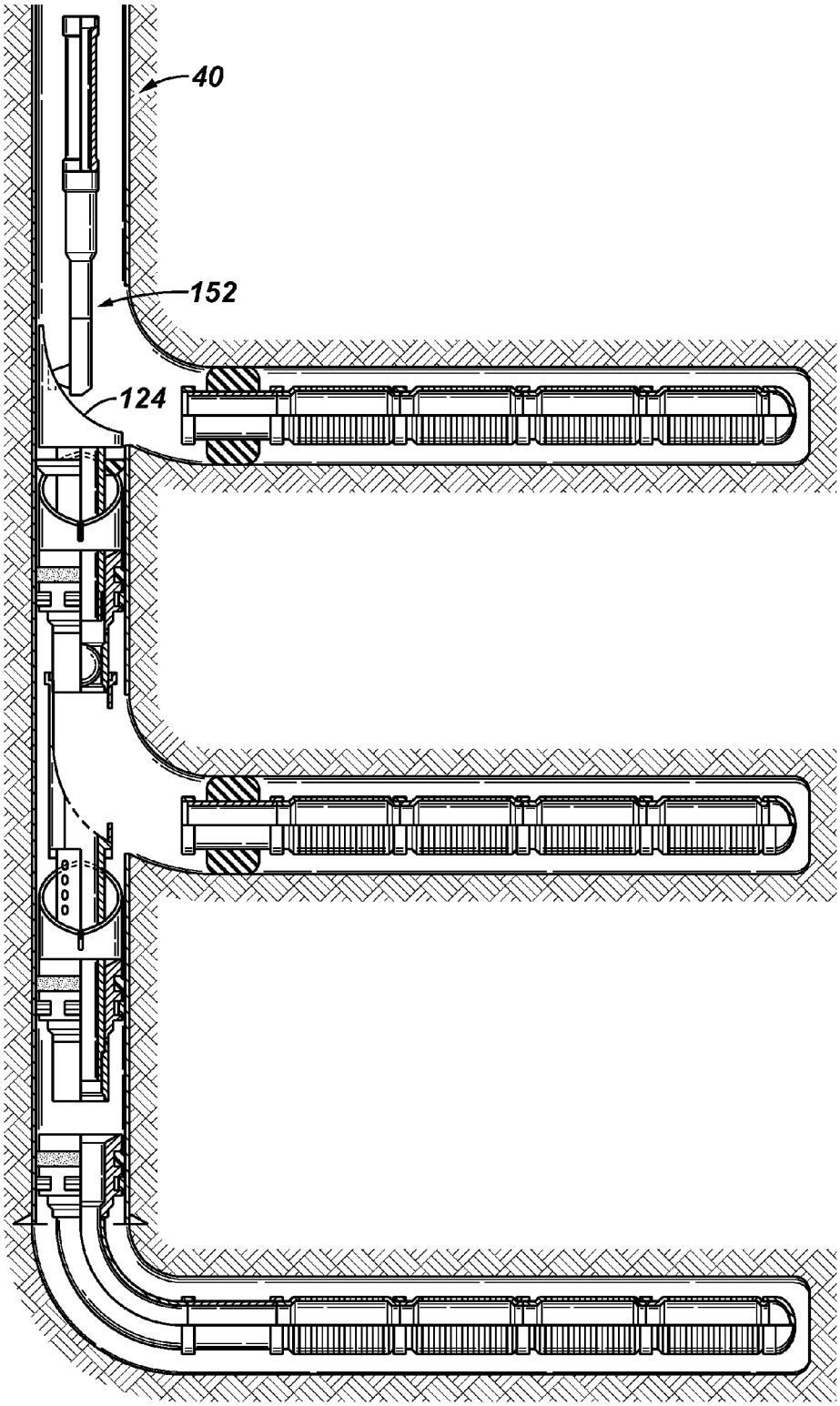
FIG. 15 is a schematic diagram of an example hook and fishing assembly for retrieving a lateral drilling whipstock.

FIG. 15, similar to FIG. 9, shows an example schematic of a retrieving hook and fishing assembly 152 placed in the main wellbore 40 to release the whipstock 124 and pull it out of the well 40.

Figure 16:
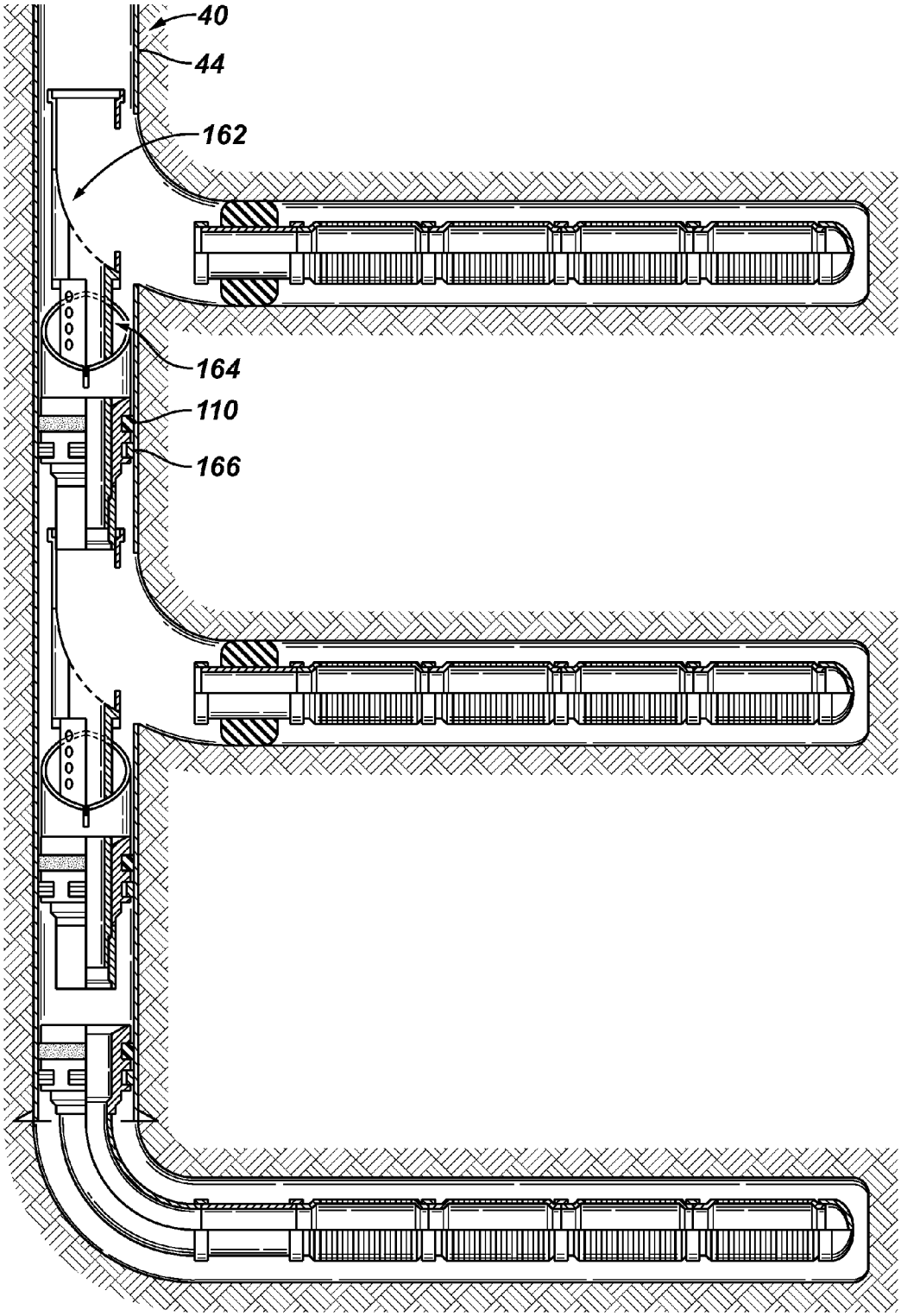
FIG. 16 is a schematic diagram of an example PRDT with selective access sleeve installed in a multilateral junction.

FIG. 16, similar to FIG. 10, shows a schematic of a second example PRDT and intervention sleeve assembly 162 that has been installed in a production latch 166 within the orientation packer 110. The PRDT and intervention sleeve assembly 162 may be attached to a bypass extender sub 164. The bypass extender sub 164 may include holes, slits, or other perforation to allow well fluids to exit the tubular and flow around the PRDT and intervention sleeve assembly 162. The PRDT of assembly 162 may be selected to have a first ID (12 in FIG. 1) size that, as will be explained, is smaller than the ID of additional PRDTs that may be installed in the well 40 above the PRDT of assembly 162, but larger than the PRDT of assembly 102 shown in FIG. 10.

Figure 17:
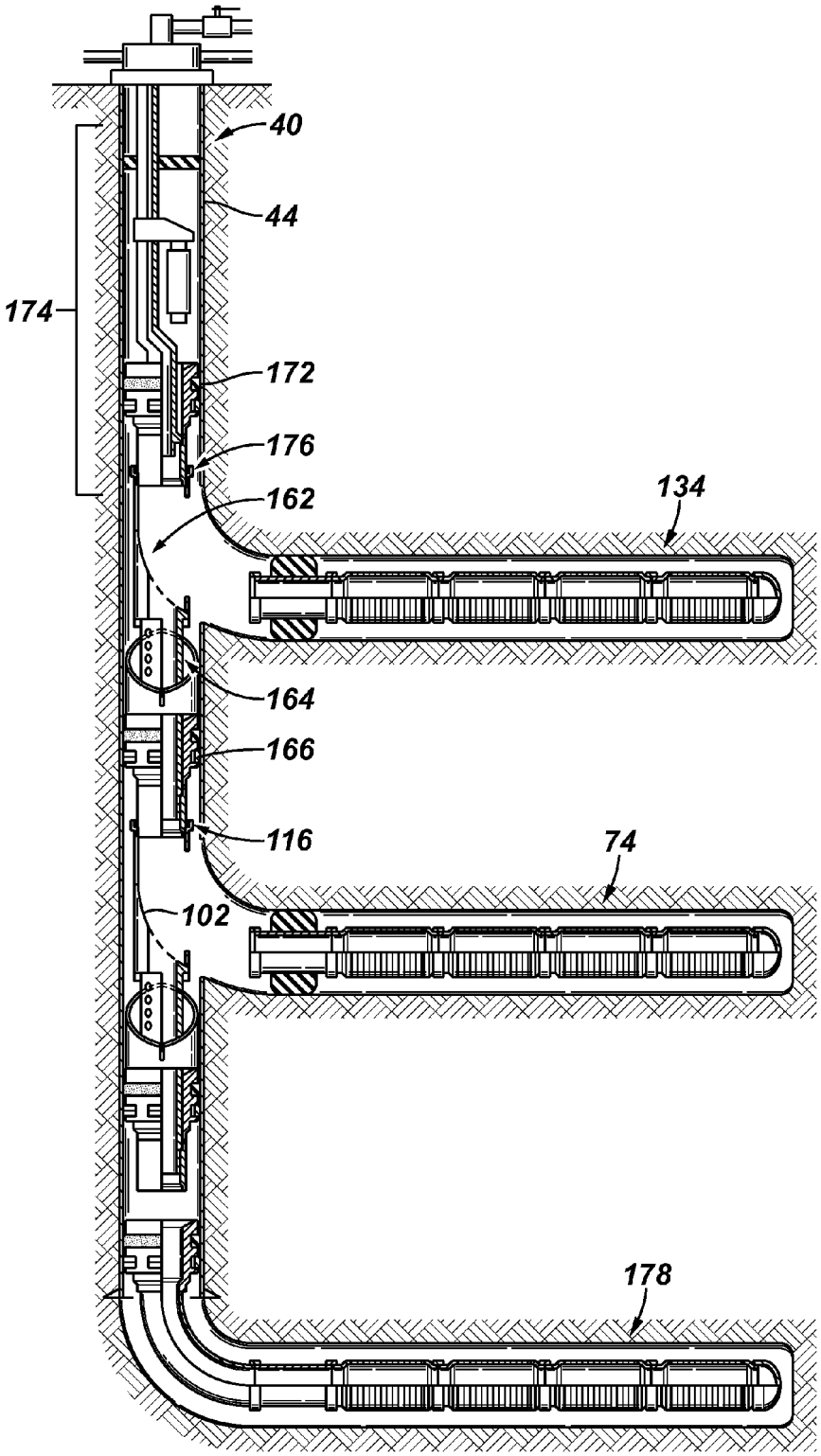
FIG. 17 is a schematic diagram showing an example of a multilateral well with an upper completion installed above the lateral wells.

FIG. 17 shows an example schematic of a production packer 172 installed within the well 40, and a stabbing guide 176 located below the packer, and just above the PRDT of assembly 162. The well 40 also includes various upper completions 174 installed above the packer 172, as is known in the art.

To enter one of the lateral wells, a coiled tubing (not shown) may be used with a selected nose. The nose (not shown) may be selected such that the size may allow passage through the PRDTs above the desired lateral but so that it will engage the PRDT at the selected lateral well. For example, if it is desired to enter the first lateral well 134 in FIG.17, a nose may be selected to that it is large enough to engage pass through the stabbing guide 176 and engage the PRDT of assembly 162. Upon engagement, the nose and the coiled tubing (not shown) will be diverted by the PRDT of assembly 162 into the first lateral well 134.

If it is desired to enter the second lateral well 74 shown in FIG. 17, a nose may be selected to that it will pass through the first PRDT 162, but that will engage the second PRDT of assembly 102 after passing through the stabbing guide 116. Such a nose will be diverted into the second lateral well 74. If it is desired to enter the lowermost lateral well 178, a nose may be selected so that it will pass through both the first and second PRDTs of assemblies 162, 102 without engagement. The nose and the coiled tubing may then continue to the lowermost lateral well 178.

It is noted that stabbing guides 176, 116 may be useful to aid in reliability of the system, but they are not required. The stabbing guides are shown only as examples that may be included in a multilateral well system.

Figure 18:
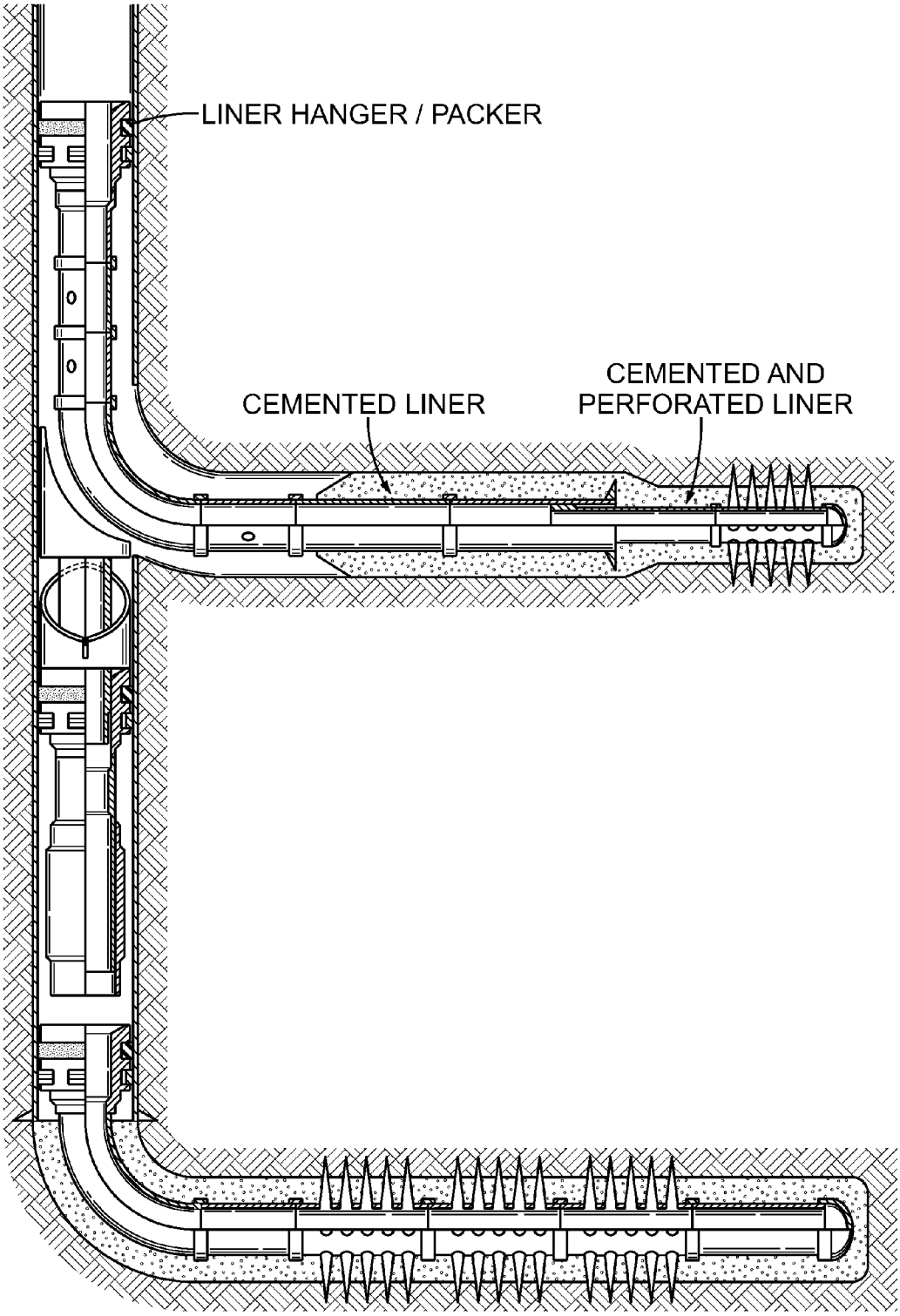
FIG. 18 is a schematic diagram showing a possible completion scenario according to another embodiment of the invention.
Figure 19:
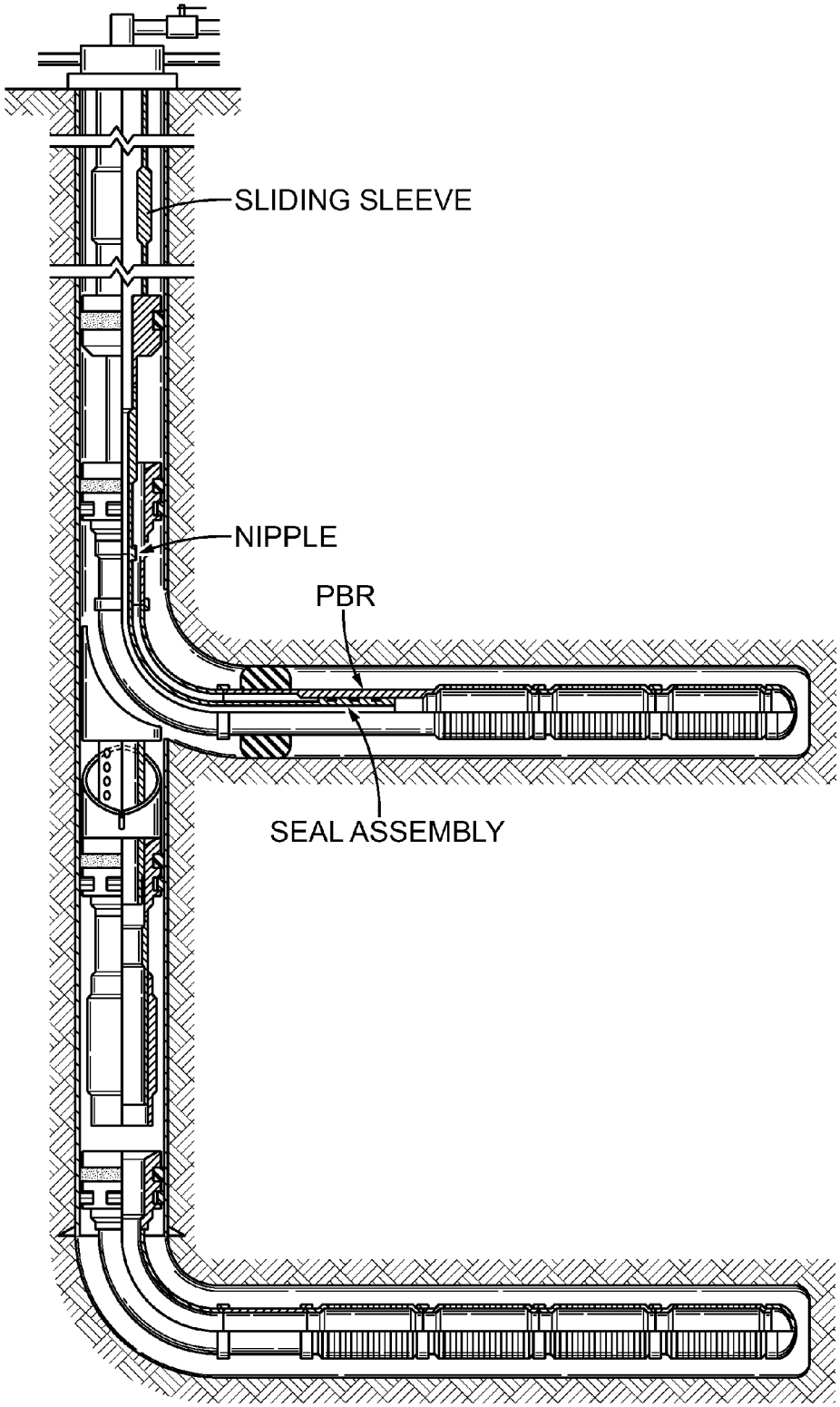
FIG. 19 is a schematic diagram showing a possible completion scenario according to another embodiment of the invention.
Figure 20:
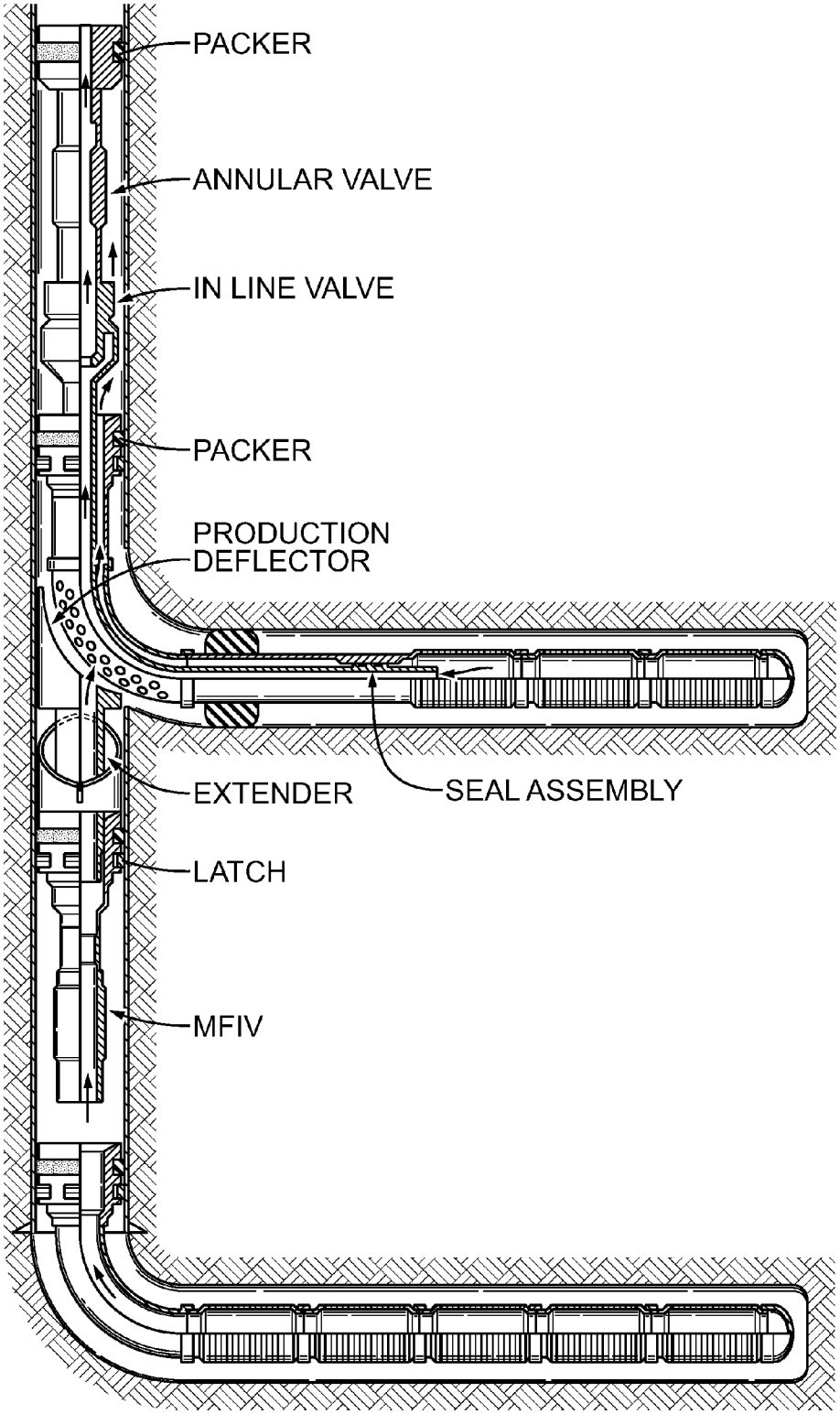
FIG. 20 is a schematic diagram showing a possible completion scenario according to another embodiment of the invention.

FIGS. 18-20 show examples of other equipment that may be used and installed using the principles of the above-described invention.

As other examples of additional embodiments of the invention, a Universal Bottom Hole Orientation (UBHO) sub and a gyroscope may be used in place of the MWD assembly 54 in accordance with other embodiments of the invention. The UBHO may have an internal diameter that is sufficient to allow the ball (or other flowable device) to pass through the UBHO, unlike the MWD assembly 54. Therefore, the ball catching sub may be located above the UBHO, for example.

The runs shown herein may be performed multiple times for creating multiple laterals off the main wellbore. Such runs may be done as described herein or in various order as known in the art.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method for constructing a multilateral well, comprising:

drilling a main well;

drilling a first lateral well from the main well;

installing a first production reentry deflection tool and intervention sleeve assembly in a first packer disposed in the main well, proximate the first lateral, a first production reentry deflection tool of the first assembly having a deflection surface intersecting a first end of a first bore extending through the first production entry tool, the first bore having a first inner diameter, the deflection surface positioned adjacent a milled window of a first intervention sleeve;

drilling a second lateral well from the main well and above the first lateral well; and installing a second production reentry deflection tool and second intervention sleeve assembly in the main well, proximate the second lateral, a second production reentry deflection tool of the second assembly having a deflection surface intersecting a first end of a second bore extending through the second projection entry deflection tool, the second bore having a second inner diameter, where the first inner diameter is smaller than the second inner diameter, and wherein the deflection surface of the second production reentry deflection tool is positioned adjacent a milled window of a second intervention sleeve.

2. The method of claim 1, further comprising:

installing a first by-pass sub below the first production reentry deflection tool and intervention sleeve assembly; and installing a second by-pass sub below the second production reentry deflection tool and intervention sleeve assembly, where the first and second by-pass subs allow well fluids to flow around the first and second production reentry deflection tool and intervention sleeve assemblies, respectively.

3. A multilateral well, comprising:

a main well;

a first lateral well extending from the main well;

a second lateral well extending from the main well, above the first well;

a first production reentry deflection sub installed in a first packer positioned in the main well proximate the first lateral well, the first production reentry deflection sub having a deflection surface intersecting a first end of a first bore extending through the first production reentry deflection sub, the first bore having a first inner diameter, the deflection surface positioned adjacent a milled window of a first intervention sleeve; and a second production reentry deflection sub positioned in the main well proximate the second lateral well, the second production reentry deflection sub having a deflection surface intersecting a first end of a second bore extending through the second production reentry deflection sub, the second bore having a second inner diameter that is larger than the first inner diameter, the deflection surface of the second production reentry deflection sub positioned adjacent a milled window of a second intervention sleeve.

* * * * *